United States Patent [19]
Logan, Jr.
[11] 4,230,193
[45] Oct. 28, 1980

[54] ROTARY DRILL BIT

[75] Inventor: Clifford K. Logan, Jr., Oklahoma City, Okla.

[73] Assignees: Arthur G. Burki; Thomas G. Wygant, both of Oklahoma City, Okla.

[21] Appl. No.: 969,810

[22] Filed: Dec. 15, 1978

[51] Int. Cl.³ ..... E21B 9/00

[52] U.S. Cl. ..... 175/379; 175/336; 175/404

[58] Field of Search ..... 175/331, 379, 382, 383, 175/403, 404, 409, 336

[56] References Cited

U.S. PATENT DOCUMENTS

| | | | |
|---|---|---|---|
| 1,163,867 | 12/1915 | Shaffer | 175/379 |
| 1,505,460 | 8/1924 | Griesche | 175/379 |
| 1,572,386 | 2/1926 | Gates | 175/379 |
| 2,203,747 | 6/1940 | Sandstone | 175/379 |
| 2,342,931 | 2/1944 | Fortune | 175/379 |
| 2,819,043 | 1/1958 | Henderson | 175/379 X |
| 2,830,795 | 4/1958 | Center, Jr. | 175/379 |
| 2,833,520 | 5/1958 | Owen | 175/379 |
| 2,966,949 | 1/1961 | Wepsala, Jr. | 175/379 |
| 3,295,617 | 1/1967 | Willis | 175/379 |
| 3,495,359 | 2/1970 | Smith et al. | 175/379 X |

*Primary Examiner*—James A. Leppink
*Assistant Examiner*—Richard E. Favreau
*Attorney, Agent, or Firm*—C. Clark Dougherty, Jr.

[57] ABSTRACT

An improved rotary drill bit comprised of two or more elongated generally cylindrical drill members the lower ends of which form a cutting face. Each of the drill members includes a plurality of vertically spaced rows of diamond-shaped openings disposed, or formed, in the sides, or wall, thereof, the openings in adjacent rows being offset from each other and overlapping at their upper and lower ends whereby as the lower ends of the drill member wear away, cutting edges are continuously formed thereon by the diamond-shaped openings.

13 Claims, 19 Drawing Figures

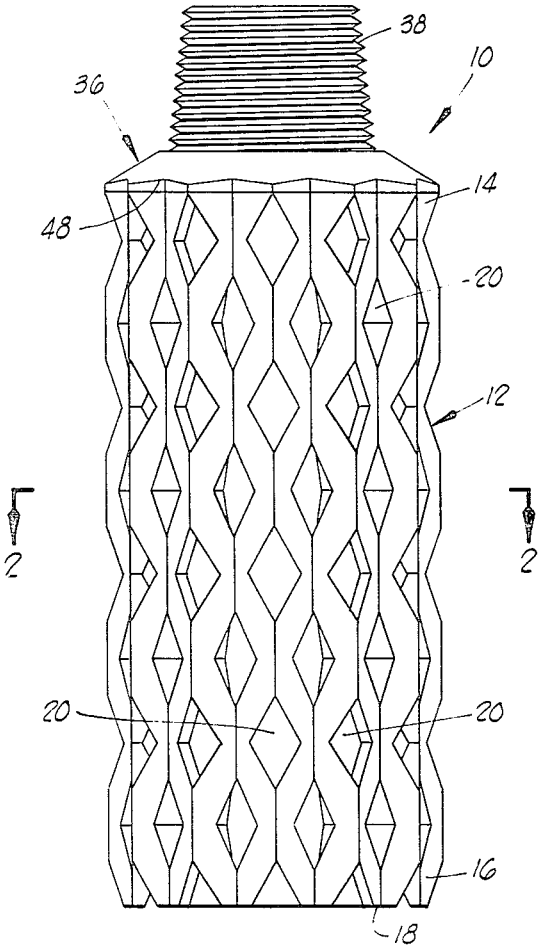
FIG. 1
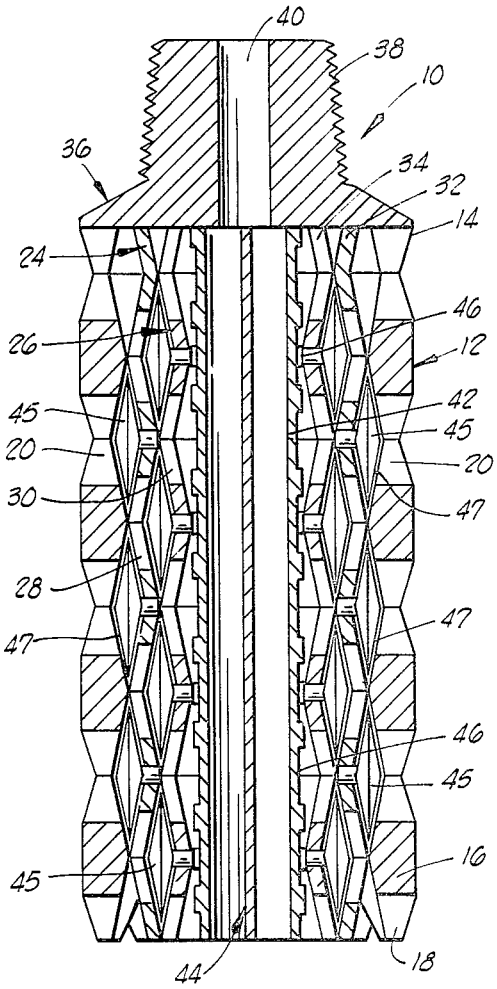
FIG. 3
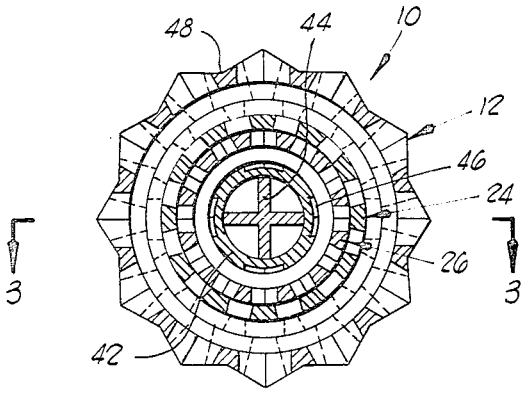
FIG. 2
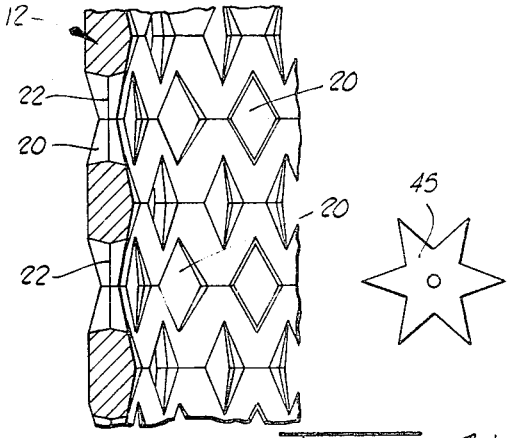
FIG. 4b
FIG. 4a

ROTARY DRILL BIT

BACKGROUND OF THE INVENTION

1. Field of the Invention

The present invention relates generally to an improved rotary drill bit, and more particularly, but not by way of limitation, to a rotary drill bit having cutting edges thereon which are continuously reformed as the drill bit wears away.

2. Description of the Prior Art

In the drilling of oil, gas and water wells by rotary drilling techniques, the drill bits utilized are subject to abrasion and deterioration whereby the teeth and/or cutting surfaces are removed making it necessary to periodically replace the drill bits. In the drilling of deep wells through hard rock and the like, drill bits often must be replaced at relatively short intervals. The replacement of the drill bit involves withdrawing the drill string from the well bore, replacing the drill bit and then reinserting the drill string into the well bore which brings about a considerable time delay and expense.

By the present invention, an improved rotary drill bit is provided which includes a cutting face having cutting edges thereon which are continuously renewed or reformed as the cutting face wears whereby replacement of the drill bit because of wear and abrasion is obviated.

It is, therefore, a general object of the present invention to provide an improved rotary drill bit.

A further object of the present invention is the provision of a rotary drill bit having a cutting face with cutting edges thereon which are continuously reformed as the cutting face wears thereby making it unnecessary to replace the drill bit during drilling operations.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 1 is a side elevational view of the improved rotary drill bit of the present invention.

FIG. 2 is a cross-sectional view taken along line 2—2 of FIG. 1.

FIG. 3 is a cross-sectional view taken along line 3—3 of FIG. 2.

FIG. 4*a* is a fragmentary view of a portion of the apparatus illustrated in FIGS. 1–3.

FIG. 4*b* is a front view of a different portion of the apparatus illustrated in FIGS. 1–3.

FIG. 6 is a cross-sectional view taken along line 6—6 of FIG. 5.

DESCRIPTION OF PREFERRED EMBODIMENTS

Figure 5:
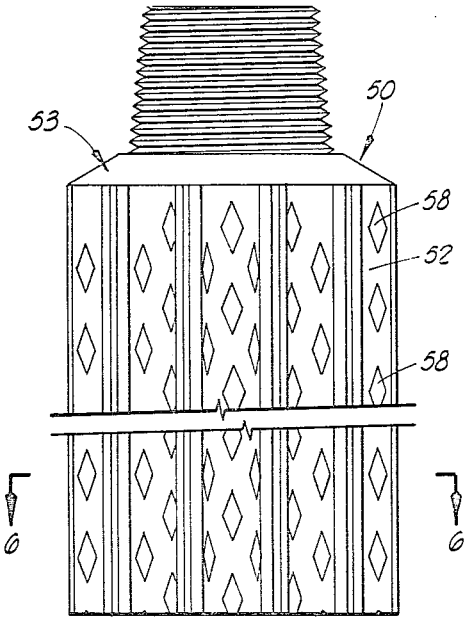
FIG. 5 is a side elevational view of an alternate embodiment of the drill bit of the present invention.
Figure 9:
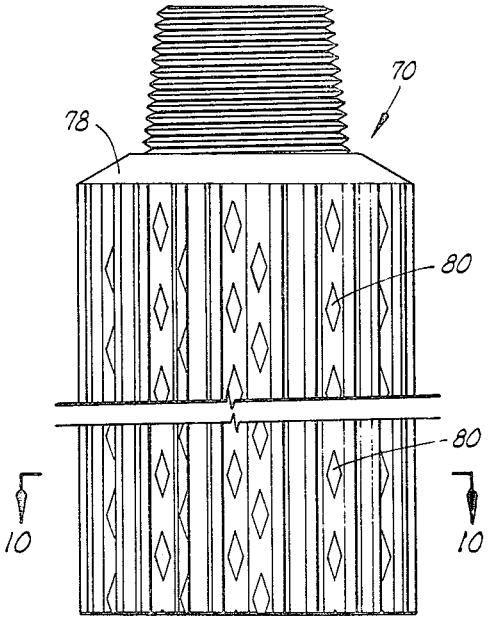
FIG. 9 is a side elevational view of yet another embodiment of the apparatus of the present invention.

Referring now to FIGS. 1–4, the drill bit apparatus of the present invention is illustrated and generally designated by the numeral 10. The apparatus 10 is comprised of an elongated generally cylindrical outer drill member 12 having an upper end 14 and a lower end 16 which forms an annular cutting face 18. A plurality of vertically spaced rows of diamond-shaped openings 20 are disposed in the sides, or, in other words, formed in the wall, of the outer drill member 12. As best shown in FIGS. 1 and 4, the openings 20 in adjacent rows are offset from each other and overlap at their upper and lower ends. Preferably, and as shown in FIG. 4, each of the diamond-shaped openings include inside surfaces which are beveled whereby a sharp edge 22 is formed therein. A plurality of continuous longitudinal recesses 48 are formed in the outer surface of the outer drill member 12.

Positioned concentrically within the outer drill member 12 are a pair of inner drill members 24 and 26. That is, the inner drill member 24 is of a size such that it fits snugly within the outer drill member 12 and the inner drill member 26 is of a size such that it fits snugly within the inner drill member 24. The inner drill members 24 and 26 are of lengths corresponding to the outer drill member 12 and both include rows of diamond-shaped openings 28 and 30 formed therein with the openings in adjacent rows being offset from each other and overlapping at their upper and lower ends in the same manner as the openings 20 in the outer drill member 12. The upper end 14 of the outer drill member 12 and the upper ends 32 and 34 of the inner drill members 24 and 26 respectively, are welded to a bit head 36. The bit head 36 includes a threaded shank 38 adapted to be connected to a drill string in the usual manner and a passageway 40 is provided in the bit head 36 for conducting drilling fluid from the drill string into the drill bit 10.

Positioned within the inner drill member 26 is a drilling fluid conduit 42. The conduit 42 is of a length corresponding to the outer and inner drill members and is seal welded to the bit head 36 over the passageway 40 thereof. Positioned within and welded to the inside surfaces of the drilling fluid conduit 42 is an elongated cutter member 44 which is X-shaped in cross section. That is, two elongated plates are welded together to form the member 44 having an X-shape in cross section and the member 44 is in turn welded within the drilling conduit 42 whereby it extends the full length of the drilling fluid conduit. As will be understood by those skilled in the art, a single plate which intersects the center line of the drilling fluid conduit can be used or the cutter member 44 can have a star-shaped cross section.

As best shown in FIG. 3, the walls of each of the inner drill members 24 and 26 are of zig-zag shape in vertical cross section and the inside surfaces of the outer drill member 12 are formed in a corresponding zig-zag shape. As shown in FIGS. 2 and 3, the drilling fluid conduit includes a plurality of vertically spaced rows of diamond-shaped indentations or recesses 46 formed in the outer surface thereof. The recesses 46 in adjacent rows are offset from each other and overlap at their upper and lower ends in the same manner as the diamond-shaped openings 20, 28 and 30 in the outer drill member 12, and the inner drill members 24 and 26, respectively.

The entire drill bit 12 is formed of hard steel or other strong hard material and the various parts described above are welded together so that a rigid structure results. In operation of the drill bit 10, the threaded shank 38 of the bit head 36 is connected to a drill string in a conventional manner and the drill string and drill bit 10 are used to drill a well bore using conventional rotary drilling techniques. The lower ends of the outer drill member 12 and inner drill members 24 and 26 form annular cutting faces including cutting edges formed by the diamond-shaped openings therein. As the drill bit 10 is rotated against an earth formation through which a well bore is to be drilled, drilling fluid pumped through the drill string flows through the bit head 36 and the drilling fluid conduit 42 and is discharged at the bottom of the drill bit 10 from where it flows by way of the longitudinal recesses 48 in the outside surface of the outer drill member 12 above the drill bit 10 and up the well bore to the surface. The drilling fluid is circulated in the usual manner and serves to carry the bit cuttings to the surface as well as cool and lubricate the cutting faces of the drill bit 10. As the bottom annular cutting faces of the outer drill member 12 and inner drill members 24 and 26 are worn down due to abrasion, new cutting edges are continuously formed because of the overlapping diamond-shaped openings 20, 28 and 30 disposed therein. The drilling fluid conduit 42 and the cutter member 44 also wear away as the drill bit 10 is rotated. The diamond-shaped recesses 46 provided in the outside surface of the drilling fluid conduit 42 continuously provide cutting edges on the conduit 42 as it is abraded and the cutter member 44 functions to cut the center portion of the hole being drilled. As will be understood by those skilled in the art, the overall length of the drill bit 10 is such that it can be utilized for drilling a well bore of any depth without being replaced thereby avoiding the necessity of periodically pulling the drill string for such purpose. The diamond-shaped openings in the drill members and the diamond-shaped recesses in the drilling fluid conduit bring about the continuous presence of cutting edges on the cutting face of the drill bit 10 as the cutting face wears. When the diamond-shaped openings in the drill members are beveled whereby they include sharp edges 22 (FIG. 4*a*), the sharp edges facilitate the drilling ability of the drill bit 10. In addition, the zig-zag cross-sectional shape of the drill members increases the ability of the drill bit 10 to drill through earth formations by providing sharp edges in contact with such formations.

As shown in FIGS. 3 and 4*b*, a plurality of rotatable grinding members 45 can be positioned in the spaces 47 formed between the outer drill member 12 and inner drill members 24 and 26 by the zig-zag vertical cross-sectional shapes thereof. The grinding members 45 are each journaled to one of the inner drill members 24 and 26 in a suitable manner and are of diamond shape in cross-section. As shown in FIG. 4*b*, the grinding members 45 can be of star or other suitable shape whereby cutting and grinding edges are provided thereon. As the drill bit 10 is rotated against an earth formation through which a well bore is to be drilled and the drill members 12, 24 and 26, as well as the drilling fluid conduit 42 and cutter member 44 wear down due to abrasion, the grinding members 45 are also worn down. However, as will be understood, because the grinding members overlap in the same manner as the diamond-shaped openings in the drill members, as the grinding members in contact with the earth formation being drilled are completely worn away, additional grinding members are brought into contact with the formation.

Figure 8:
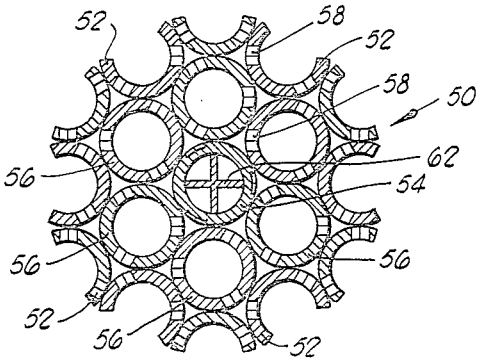
FIG. 8 is a cross-sectional view taken along line 8—8 of FIG. 7.
Figure 10:
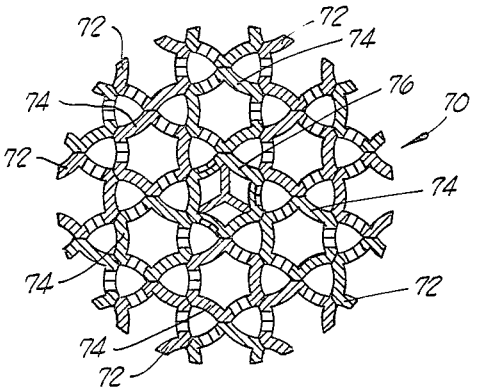
FIG. 10 is a cross-sectional view taken along line 10—10 of FIG. 9.
Figure 7:
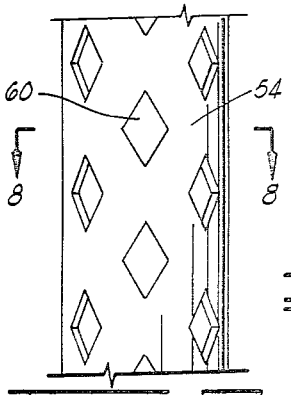
FIG. 7 is a fragmentary view of a portion of the apparatus illustrated in FIGS. 5 and 6.
Figure 8:
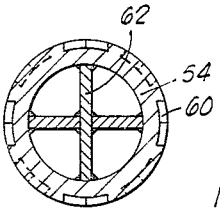

Referring now to FIGS. 5-8, an alternate embodiment of the drill bit of the present invention is illustrated and generally designated by the numeral 50. The drill bit 50 is comprised of an outer generally cylindrical drill member made up of a plurality of elongated semi-cylindrical members 52 which are welded together and welded to a bit head 53. The bit head 53 includes a passageway (not shown) extending longitudinally therethrough and a centrally positioned elongated drilling fluid conduit 54 is seal welded over the opening in the bottom of the bit head 53. Positioned symmetrically around the drilling fluid conduit 54 and within the cylindrical structure formed by the semi-cylindrical members 52 are a plurality of elongated cylindrical drill members 56 which are welded to the bit head 53, welded to each other and welded to the drilling fluid conduit 54 and semi-cylindrical members 52. Each of the semi-cylindrical members 52 and cylindrical members 56 includes a plurality of vertically spaced rows of diamond-shaped openings 58 formed in the sides thereof whereby the openings 58 in adjacent rows are offset from each other and overlap at their upper and lower ends in the same manner as described above in connection with the apparatus 10. In addition, as shown in FIGS. 7 and 8, the drilling fluid conduit 54 includes a plurality of vertically spaced rows of diamond-shaped recesses 60 and an elongated cutter member 62 is disposed within and throughout the length of the drilling fluid conduit 54 in the same manner as previously described.

As will be understood by those skilled in the art, the lower ends of the members 52 and 56 and the drilling fluid conduit 54 form a cutting face having cutting edges formed thereon by the diamond-shaped openings 58 in the members 52 and 56 and the diamond-shaped recesses 60 in the drilling fluid conduit 54. As the drill bit 50 is rotated against a formation through which a well bore is to be drilled, the cutting face abrades and wears away but cutting edges are continuously formed thereon in the same manner as described above in connection with the drill bit 10.

Figure 11:
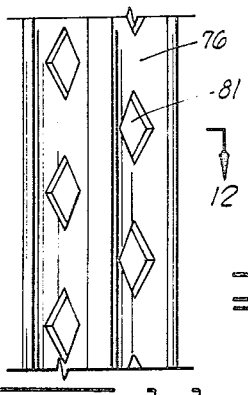
FIG. 11 is a fragmentary view of a portion of the apparatus illustrated in FIGS. 9 and 10.
Figure 12:
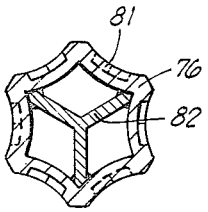
FIG. 12 is a cross-sectional view taken along line 12—12 of FIG. 11.

Referring now to FIGS. 9-12, yet another embodiment of the present invention is illustrated and generally designated by the numeral 70. The apparatus 70 is similar to the apparatus 50 previously described except that the elongated semi-hexagonal members 72 are utilized to form the generally cylindrical outer drill member, and the inner drill members 74 and drilling fluid conduit 76 are hexagonal in cross-sectional shape. The members 72, 74 and 76 are welded to a bit head 78 and to each other in the same manner as described in connection with the apparatus 50 and a plurality of vertically spaced rows of diamond-shaped openings 80 are provided in the members 72 and 74. As shown in FIGS. 11 and 12, the drilling fluid conduit 76 includes a plurality of vertically spaced rows of diamond-shaped recesses 81 and an elongated cutting assembly 82 of star shape in cross section is welded within and throughout the length of the drilling fluid conduit 76. The operation of the apparatus 70 is identical to the operation of the apparatus 10 and 50 described above. The hexagonal cross-sectional shape of the members 72, 74 and 76 of the apparatus 70 provides additional self-renewable cutting edges on the cutting face of the apparatus.

Figure 13:
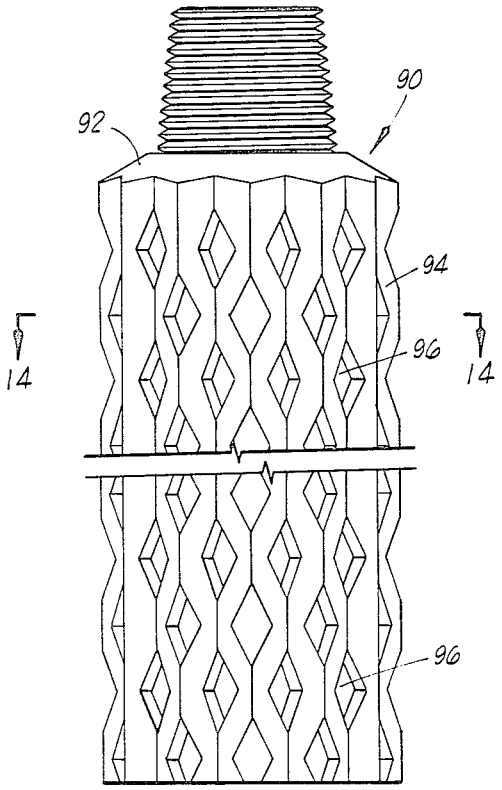
FIG. 13 is a side elevational view of a further embodiment of the present invention.

Referring now to FIGS. 13-18, additional embodiments of the drill bit of the present invention are illustrated. In FIG. 13, a drill bit is illustrated and generally designated by the numeral 90. The apparatus 90 includes a bit head 92 and an outer drill member 94 which is identical to the outer drill member 12 described in connection with the apparatus 10. That is, the outer drill member 94 includes a plurality of vertically spaced rows of diamond-shaped openings 96 disposed in the sides thereof with the openings in adjacent rows being offset from each other and overlapping at their upper and lower ends whereby as the lower end of the outer drill member 94 wears away, cutting edges are continuously formed therein by the openings 96.

Figure 14:
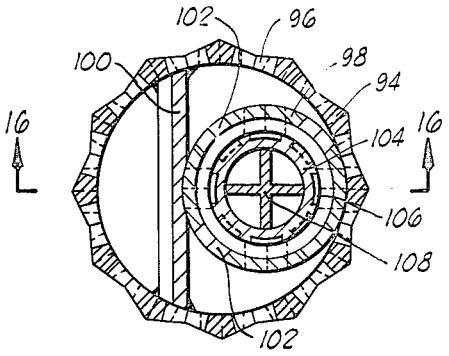
FIG. 14 is a cross-sectional view taken along line 14—14 of FIG. 13.
Figure 16:
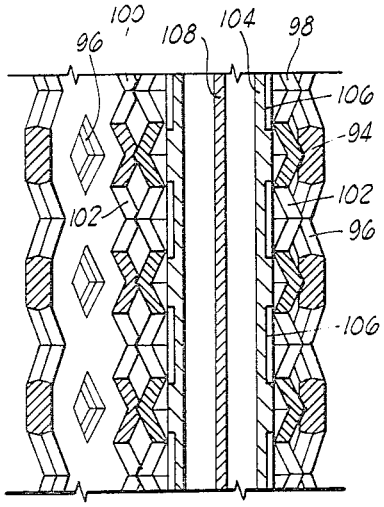
FIG. 16 is a cross-sectional view taken along line 16—16 of FIG. 14.

Referring specifically to FIGS. 14 and 16, an inner drill member 98 having a length corresponding to the length of the outer drill member 94 is provided journaled between the inside surface of the outer drill member 94 and an internal stationary wall 100 which extends longitudinally throughout the length of the outer drill member 94 and is welded thereto. Both the inner drill member 98 and the stationary wall 100 include a plurality of vertically spaced rows of diamond-shaped openings 102 formed therein. As will be understood, the outer drill member 94 and the wall 100 are both rigidly welded to the bit head 92, but the inner drill member 98 is not welded to the bit head 92 so that it is free to rotate within and between the outer drill member 92 and the wall 100.

A drilling fluid conduit 104 is disposed within the inner drill member 98, the upper end of which is seal welded to the bottom of the bit head 92 over the opening of a passageway formed therein for conducting drilling fluid from a drill string to the drilling fluid conduit 104. As will be understood, the passageway (not shown) in the bit head 92 is offset so that the opening in the bottom of the bit head 92 is in alignment with the drilling fluid conduit 104. The drilling fluid conduit includes a plurality of vertically spaced rows of diamond-shaped recesses 106 formed in the outside surface thereof and a continuous cutter having an X-shape in cross section disposed therein.

Figure 15:
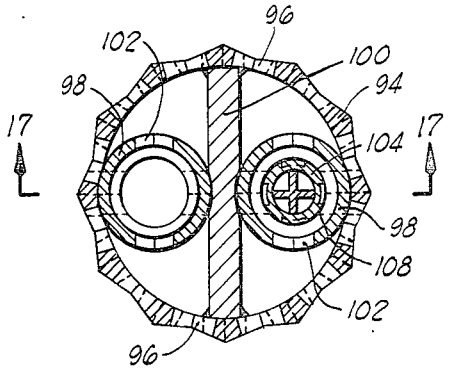
FIG. 15 is a cross-sectional view similar to FIG. 14 but showing an alternate arrangement of apparatus.
Figure 17:
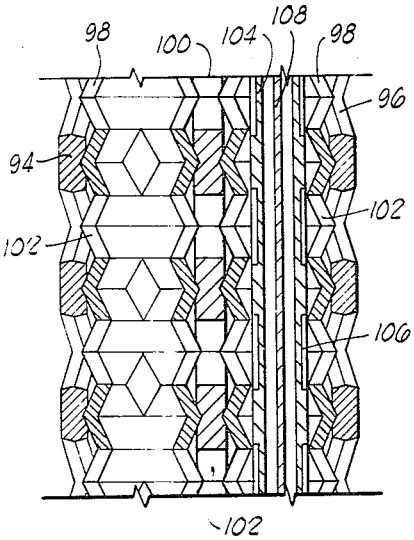
FIG. 17 is a cross-sectional view taken along line 17—17 of FIG. 15.
Figure 18:
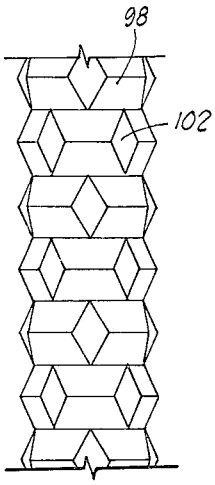
FIG. 18 is a fragmentary view of a portion of the apparatus of FIGS. 13–17.

In yet another alternate embodiment of the drill bit 90 and as shown in FIGS. 15 and 17, two inner drill members 102 are journaled within the outer drill member 94 between opposite internal sides of the outer drill member 94 and a stationary wall 100 welded within the outer drill member 94 and extending longitudinally therein. The drilling fluid conduit 104 is positioned within one of the inner drill members 102.

The operation of the drill bit 90 in either of the embodiments described is identical to the operation of the drill bits 10, 50 and 70 described above except that the inner drill member or members 90 are free to rotate independently. That is, when the drill bit 90 is rotated in one direction, the inner drill member or members 98 thereof rotate in an opposite direction. Because of the vertically spaced rows of diamond-shaped openings 102 in the outer drill member 94, the inner drill member or members 98, the stationary wall 100 and because of the diamond-shaped recesses 106 in the drilling fluid conduit 104, self-renewing cutting edges are provided on the cutting face of the drill bit 90 as the drill bit 90 abrades.

As stated above, because the improved rotary drill bit of the present invention can be of a length such that it does not wear down completely and because the cutting edges on the cutting face of the drill bit are self-renewing, a single drill bit can be utilized in drilling a well bore whereby the necessity of periodically pulling the drill string to replace the drill bit is obivated.

While presently preferred embodiments of the present invention have been described herein for purposes of this disclosure, numerous changes in the arrangement and construction of parts can be made by those skilled in the art, which changes are embodied within the spirit of this invention as defined by the appended claims.

What is claimed is:

1. An improved rotary drill bit comprising:

an elongated generally cylindrical outer drill member having an upper end and a lower end forming an annular cutting face and having a plurality of vertically spaced rows of diamond-shaped openings formed in the wall thereof, the diamond-shaped openings in adjacent rows being offset from each other and overlapping at their upper and lower ends whereby as said lower end of said outer drill member wears away, cutting edges are continuously formed thereon by said diamond-shaped openings;

at least one elongated generally cylindrical inner drill member disposed within said outer drill member having a length corresponding to said outer drill member, an upper end and a lower end forming an annular cutting face and having a plurality of vertically spaced rows of diamond-shaped openings formed in the wall thereof, the diamond-shaped openings in adjacent rows being offset from each other and overlapping at their upper and lower ends whereby as said lower end of said inner drill member wears away, cutting edges are continuously formed thereon by said diamond-shaped openings;

a non-perforate drilling fluid conduit disposed in said outer drill member for conducting drilling fluid from the upper ends of said outer and inner drill members solely to the lower ends thereof, said fluid conduit having diamond-shaped recesses formed in the outer surface thereof; and means for connecting said outer drill member, inner drill member and drilling fluid conduit to a string of drill pipe and for conducting drilling fluid to said drilling fluid conduit.

2. The drill bit of claim 1 wherein said inner drill member is rotatably attached to said outer drill member.

3. The drill bit of claim 1 which is further characterized to include at least one continuous longitudinally extending cutter plate disposed within and attached to the inside surfaces of said drilling fluid conduit so that said cutter plate intersects the center line of said drilling fluid conduit.

4. The drill bit of claim 3 wherein said outer drill member includes at least one continuous vertical recess formed in the outside surface thereof.

5. The drill bit of claim 1 which is further characterized to include a plurality of rotatable grinding members positioned between said outer drill member and said inner drill member.

6. An improved rotary drill bit comprising:

an elongated generally cylindrical outer drill member having an upper end and a lower end forming an annular cutting face and having a plurality of vertically spaced rows of diamond-shaped openings formed in the wall thereof, the diamond-shaped openings in adjacent rows being offset from each other and overlapping at their upper and lower ends whereby as said lower end of said outer drill member wears away, cutting edges are continuously formed therein by said diamond-shaped openings;

a plurality of elongated generally cylindrical inner drill members concentrically disposed one within the other and within said outer drill member, each of said inner drill members having upper ends and lower ends forming annular cutting faces and having a plurality of vertically spaced rows of diamond-shaped openings formed in the wall thereof, the diamond-shaped openings in adjacent rows being offset from each other and overlapping at their upper and lower ends whereby as the lower ends of said inner drill members wear away, cutting edges are continuously formed thereon by said diamond-shaped openings therein;

a non-perforated drilling fluid conduit concentrically disposed within the innermost of, and along the entire length of, said inner drill members for conducting drilling fluid from the upper ends of said inner and outer drill members to the lower ends thereof, said fluid conduit having a plurality of diamond-shaped recesses formed in the outer surface thereof; and means for connecting said outer drill member, inner drill members and drilling fluid conduit to a string of drill pipe and for conducting drilling fluid to said drilling fluid conduit.

7. the drill bit of claim 6 which is further characterized to include a plurality of rotatable grinding members positioned between said outer drill member and said inner drill member.

8. The drill bit of claim 6 which is further characterized to include at least one continuous longitudinally extending cutter plate disposed within said drilling fluid conduit so that said cutter plate intersects the center line of said drilling fluid conduit.

9. The drill bit of claim 8 wherein said outer drill member includes a plurality of spaced continuous vertical recesses formed in the outside surface thereof.

10. An improved rotary drill bit comprising:

an elongated generally cylindrical outer drill member including a plurality of elongated semi-cylindrical members connected to each other at the sides thereof, said connected semi-cylindrical members having an upper end and a lower end forming an annular cutting face and having a plurality of vertically spaced rows of diamond-shaped openings formed in the walls thereof, the diamond-shaped openings in adjacent rows being offset from each other and overlapping at their upper and lower ends whereby as said lower end of said connected semi-cylindrical members wears away, cutting edges are continuously formed thereon by said diamond-shaped openings;

a plurality of elongated generally cylindrical inner drill members disposed within said outer drill member, each of said inner drill members having upper ends and lower ends forming annular cutting faces and having a plurality of vertically spaced rows of diamond-shaped openings formed in the wall thereof, the diamond-shaped openings in adjacent rows being offset from each other and overlapping at their upper and lower ends whereby as said lower ends of said inner drill members wear away, cutting edges are continuously formed thereon by said diamond-shaped openings;

a drilling fluid conduit disposed within said outer drill member for conducting drilling fluid from the upper ends of said inner and outer drill members to the lower ends thereof; and means for connecting said outer drill member, said inner drill members and said drilling fluid conduit to a string of drill pipe and for conducting drilling fluid to said drilling fluid conduit.

11. The drill bit of claim 10 wherein said drilling fluid conduit is positioned on a line coinciding with the axis of said drill bit and said inner drill members are positioned in a circle around said drilling fluid conduit.

12. The drill bit of claim 11 which is further characterized to include at least one continuous longitudinally extending cutter plate disposed within said drilling fluid conduit.

13. An improved rotary drill bit comprising: an elongated generally cylindrical outer drill member having an upper end and a lower end forming an annular cutting face and having a plurality of vertically spaced rows of diamond-shaped openings formed in the wall thereof, the diamond-shaped openings in adjacent rows being offset from each other and overlapping at their upper and lower ends whereby as said lower end of said outer drill member wears away, cutting edges are continuously formed thereon by said diamond-shaped openings;

at least one elongated generally cylindrical inner drill member disposed within said outer drill member having a length corresponding to said outer drill member, an upper end and a lower end forming an annular cutting face and having a plurality of vertically spaced rows of diamond-shaped openings formed in the wall thereof, the diamond-shaped openings in adjacent rows being offset from each other and overlapping at their upper and lower ends whereby as said lower end of said inner drill member wears away, cutting edges are continuously formed thereon by said diamond-shaped openings;

a non-perforate drilling fluid conduit disposed in said outer drill member for conducting drilling fluid from the upper ends of said outer and inner drill members solely to the lower ends thereof;

means for connecting said outer drill member, inner drill member and drilling fluid conduit to a string of drill pipe and for conducting drilling fluid to said drilling fluid conduit; and a plurality of rotatable grinding members positioned between said outer drill member and said inner drill member.

* * * * *